US007448992B2

(12) United States Patent
Grimwood et al.

(10) Patent No.: US 7,448,992 B2
(45) Date of Patent: Nov. 11, 2008

(54) WASHING OF SEPARATED SOLIDS IN SOLID BOWL AND SCREEN BOWL DECANTING CENTRIFUGES

(75) Inventors: Geoffrey Clive Grimwood, Holmfirth (GB); John Wright, Huddersfield (GB)

(73) Assignee: Thomas Broadbent & Sons Limited, Huddersfield (GB)

( * ) Notice: Subject to any disclaimer, the term of this patent is extended or adjusted under 35 U.S.C. 154(b) by 126 days.

(21) Appl. No.: 11/049,627

(22) Filed: Feb. 1, 2005

(65) Prior Publication Data

US 2005/0192173 A1 Sep. 1, 2005

(30) Foreign Application Priority Data

Feb. 7, 2004 (GB) ..... 0402630.8

(51) Int. Cl.
*B04B 1/20* (2006.01)
*B04B 15/12* (2006.01)

(52) U.S. Cl. ..... 494/29; 494/53; 210/380.3

(58) Field of Classification Search ..... 494/23–30, 494/36, 43, 50–55; 210/380.1, 380.3
See application file for complete search history.

(56) References Cited

U.S. PATENT DOCUMENTS 3,279,688 A * 10/1966 Cook ..... 494/10
3,348,767 A * 10/1967 Ferney ..... 494/27
3,368,747 A * 2/1968 Lavanchy et al. ..... 494/53
3,575,709 A * 4/1971 Ferney ..... 127/56
3,802,621 A * 4/1974 Merzenich ..... 494/29
3,967,778 A * 7/1976 Hunwick ..... 494/29
4,142,669 A * 3/1979 Burlet ..... 494/53
4,190,194 A * 2/1980 Amero ..... 494/27
4,299,352 A * 11/1981 Erickson ..... 494/27
4,496,340 A * 1/1985 Redeker et al. ..... 494/29
4,654,022 A * 3/1987 Shapiro ..... 494/29
5,509,882 A * 4/1996 Caldwell ..... 494/29
5,584,791 A * 12/1996 Grimwood et al. ..... 494/54
5,653,673 A * 8/1997 Desai et al. ..... 494/27
5,958,235 A 9/1999 Leung
6,193,643 B1 * 2/2001 Larsson ..... 494/26
7,140,494 B2 * 11/2006 Fujimoto et al. ..... 210/369

(Continued)

FOREIGN PATENT DOCUMENTS

EP 1561511 A1 * 8/2005

(Continued)

*Primary Examiner*—Charles E Cooley
(74) *Attorney, Agent, or Firm*—Christensen O'Connor Johnson Kindness PLLC

(57) ABSTRACT

A solid or screen bowl decanting-type centrifuge comprising:

a rotatable bowl; a helical scroll conveyor which rotates coaxially within the bowl at a different rotational speed, the helical scroll comprising a hub carrying a plurality of flights whose radially outer edges lie close to an inner wall of the bowl such that, in use, solids are scrolled by the conveyer to solids discharge ports at one end of the bowl, with separated liquid being discharged from liquids discharge ports at the opposite end of the bowl. The conveyor hub carries a plurality of nozzles in a wash zone for supplying wash fluid to solids being scrolled by the conveyer towards the solids discharge ports. The conveyor hub also carries a blade in the region of the nozzles and intermediate adjacent flights of the conveyor for directing fluid droplets from the nozzles over said solids.

20 Claims, 6 Drawing Sheets

U.S. PATENT DOCUMENTS

2005/0192173 A1 * 9/2005 Grimwood et al. ..... 494/29

FOREIGN PATENT DOCUMENTS

JP 2-160063 * 6/1990
JP 10-28899 A 2/1998
JP 2000-350946 A 12/2000
JP 2003-93924 A 4/2003
JP 2004-202436 * 7/2004

* cited by examiner

WASHING OF SEPARATED SOLIDS IN SOLID BOWL AND SCREEN BOWL DECANTING CENTRIFUGES

FIELD OF THE INVENTION

The present invention is concerned with improving the washing of separated solids in solid bowl and screen bowl decanting centrifuges.

BACKGROUND OF THE INVENTION

Decanting type centrifuges employ a bowl which rotates about a horizontal or vertical axis and contains a helical scroll conveyor to separate a slurry fed thereto into its constituent solids and liquid. The helical conveyor rotates at a slightly different speed within the bowl to scroll the heavier solids to discharge ports at a smaller diameter end of the bowl. The separated liquid flows in the opposite direction and is discharged from ports at the opposite end of the bowl. The decanter can be of two principal types, either solid bowl or screen bowl. In the latter, the solids are scrolled by the conveyor over an additional perforated screen section attached to the smaller diameter end of the bowl prior to discharge.

Existing decanter centrifuges of both the solid screen bowl types operate when fed with a slurry containing solids with a higher specific gravity than the liquid constituent of the slurry, either to:

(a) separate the solid particles from the liquid, or (b) classify the solids, that is to divide the solids so that particles above a certain size are discharged as solids and particles below that size are discharged with the liquid.

For both separation and classification, the rotation of the decanter applies centrifugal force to the slurry to promote rapid settling of the higher specific gravity solids for scrolling and discharge. Hereinafter, the words 'separate' and "separation" when applied to solids and liquids, include 'classify' and 'classification'.

FIG. 1 of the accompanying drawings shows, in part section, a conventional solid bowl decanter operating assembly designed to rotate about a horizontal axis XX and to separate slurry fed via a feed pipe 1 and feed ports 2 into a bowl 3, which includes a cylindrical section 3A joined to a section 3B shaped as a frustrum of a cone—herein referred to as the conical bowl section. The slurry, subjected to centrifugal force fills the bowl up to an inner surface level 4 determined by the radial position of liquid outlet ports 5. A conveyor hub 6, coaxially mounted within the bowl 3 and supported on bearings 7, carries scrolling flights 8 wound in a helix and attached to the hub 6. The plane of the scrolling flights tilts forward to subtend an angle (a), typically 1°-7°, from a perpendicular line from the wall of the cylindrical 3A or the conical 3B sections of the bowl 3. A gearbox (not shown) drives the conveyor 6 in the same direction of rotation but at a speed slightly different from that of the bowl 3 such that, relative to the bowl, the flights 8 scroll the solids towards the solids end 9 of the decanter and discharge the solids 10 through solids outlets 11. The gearbox and rotating assembly are mounted in bearings (not shown) and rotated by a drive motor. Under centrifugal force, the solids 10 settle rapidly on the bowl inner wall and are scrolled by the conveyor flights 8 and discharged from the solids outlet 11 whilst the liquid, after primary separation, flows from the outlet ports 5.

FIG. 2 of the accompanying drawings shows in part section and to a larger scale a perforated cylindrical screen section 12 added to and extending the smaller diameter end of the conical section 3B, an extended conveyor hub 6 and extended scrolling flights 8. These additions convert the solid bowl decanter to the conventional screen bowl type and provide further separation by filtration following the primary separation in the solid bowl sections 3A and 3B as the liquid flows through perforations/slots 16.

Some processes using decanting type centrifuges require solids to be washed after the primary separation to reduce liquid retained as a thin film on the surface of the solid particles or displace this liquid with another. In the present state-of-the-art, the capacity to achieve this in both the solid and screen bowl decanters is limited. For the solid bowl, wash liquid is supplied by a wash pipe 13 fitted within or along the slurry feed pipe 1, as shown in FIG. 1, and flows through wash ports 14 in the hub to the solids bulk 10 being scrolled along the conical section 3B. The extent to which the solids are washed is limited by the tendency of the wash liquid to flow over the sloping surface 15 of the solids rather than through the bulk of the solids 10, then to flow down the helix to mix with the separated mother liquid. Also the wash liquid flow is concentrated at the wash ports giving uneven washing.

Similarly, and for the same reason, the capacity of the screen bowl decanter to wash separated solids is limited by flow over the surface 15 of the solids, as shown in FIG. 2, and by the uneven wash liquid distribution. Furthermore, any flow through the bulk of the solids carries with it fine solid particles (defined as solids that could pass through to screen perforations/slots 16) that would otherwise remain trapped in the bulk of the solids and be discharged at the solids outlet 11 by the conveyor 8.

An object of the present invention is to seek to improve the washing effectiveness and efficiency of both solid bowl and screen bowl decanting centrifuges.

SUMMARY OF THE INVENTION

In accordance with the present invention there is provided a solid or screen bowl decanting-type centrifuge comprising:

a rotatable bowl for separating a slurry fed thereto into its constituent solids and liquid;

a helical scroll conveyor which rotates coaxially within the bowl at a different rotational speed, the helical scroll comprising a hub carrying a plurality of flights whose radially outer edges lie close to an inner wall of the bowl such that, in use, separated solids are scrolled by the conveyer to solids discharge ports at one end of the bowl, with separated liquid being discharged from liquids discharge ports at the opposite end of the bowl;

a plurality of nozzles carried by the conveyor hub in a wash zone for supplying wash fluid to solids being scrolled by the conveyer towards the solids discharge ports; and at least one blade carried by the conveyor hub in the region of the nozzles and intermediate adjacent flights of the conveyor for directing fluid droplets from the nozzles over said solids.

Preferably, the blade has a radially outer edge which is spaced from the inner wall of the bowl by a greater amount than said radially outer edges of the conveyer flights.

Advantageously, the blade is shaped to follow the helix angle of the conveyor flights.

Preferably, the blade and wash zone occupy substantially 360°.

Preferably, said plurality of nozzles are disposed between adjacent conveyor flights in a line which follows the helix angle of the conveyor, the nozzles being arranged to produce respective mists of fine droplets of wash liquid which overlap to form a continuous fine spray of mist applied to the surface of said solids.

Advantageously, the centrifuge comprises a chamber in the conveyor hub which is arranged to receive wash liquid supplied by a wash liquid source and to maintain a pressure head sufficient to supply the energy required by the nozzles to deflect the wash liquid and produce the liquid droplets.

Use of various embodiments of the present invention enables improvements to be obtained in the washing efficiency of both solid bowl and screen bowl decanters by:

(i) enabling the creation of a wash zone that slows and redistributes the solids as they pass through the wash zone;

(ii) distributing the wash liquid in fine droplets evenly over the surface of solids in the wash zone;

(iii) directing the wash liquid through the volume of solids contained in the wash zone and, for the screen bowl decanter, depending on process requirements, either:

(iv) retaining the fine solids for discharge with the solids bulk, or (v) washing out and separating fine solids for discharge with the spent wash liquid.

BRIEF DESCRIPTION OF THE DRAWINGS

Specific embodiments of the present invention are described hereinafter, by way of example only, with reference to the accompanying drawings, in which.

DESCRIPTION OF THE PREFERRED EMBODIMENTS

Figure 3:
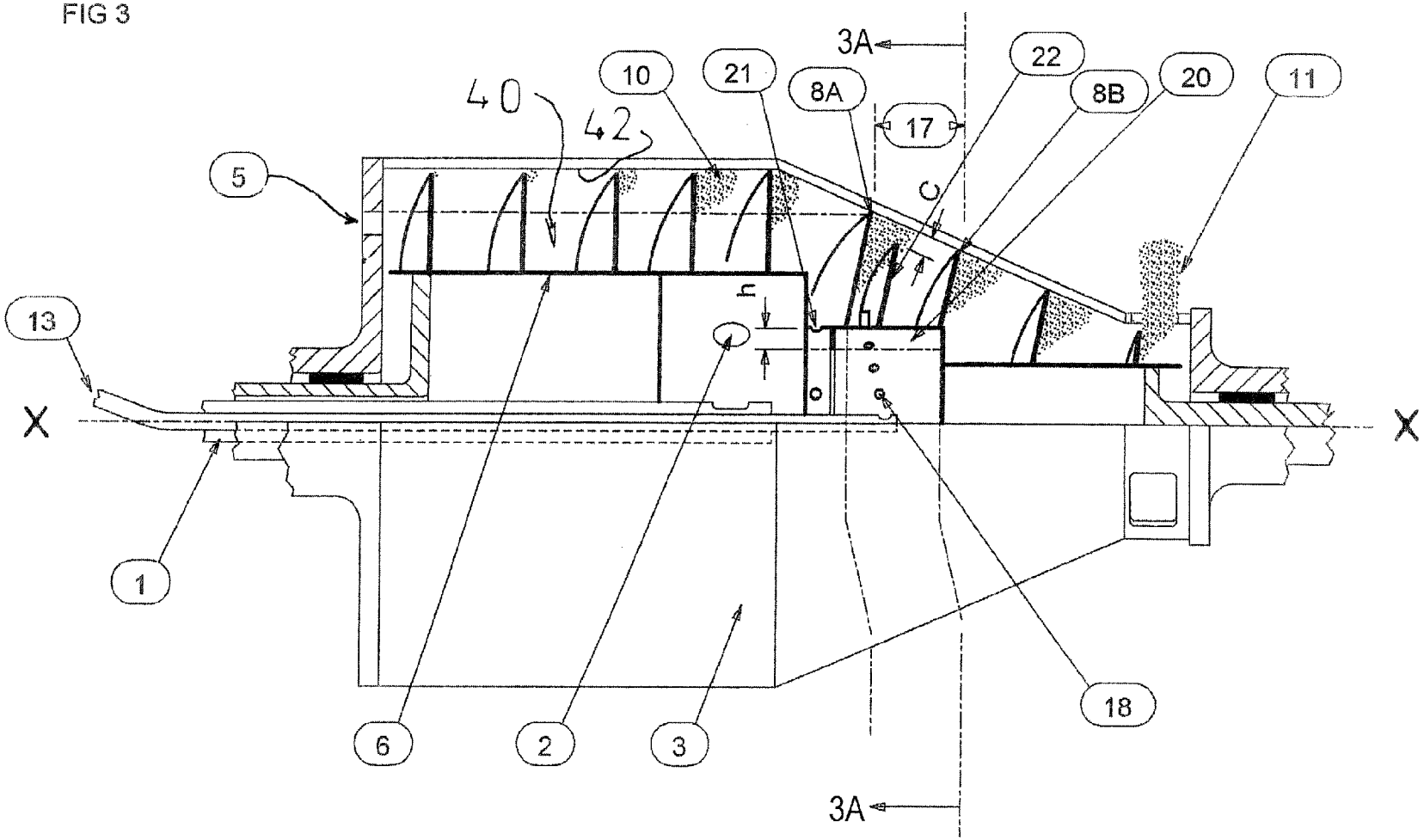
FIG. 3 is a cross-sectional view of one embodiment of the present invention in the form of a solid bowl decanter centrifuge.

The solid bowl decanter centrifuge of FIG. 3 comprises a bowl 3 having non-perforated walls and a helical scroll conveyor 40. The helical scroll conveyor 40 comprises a hub 6 having helical flights 8 projecting therefrom, an intermediate blade 22 disposed on the hub between two sections of the helical flights 8 and a plurality of nozzles 18 which are also on the hub. The bowl and hub are rotatable about a common horizontal axis XX. The hub lies inside the bowl such that the tips of the helical flights 8 almost extend to the inner surface 42 of the bowl.

A wash zone 17, defined by the volume swept by the flights 8 between position 8A and position 8B as the conveyor rotates relative to the bowl, is bounded by the corresponding frusto-conical section 3B of the bowl and the conveyor hub 6. The wash zone contains a series of nozzles 18 fitted to the conveyor hub 6 and following the helix angle of the conveyor flight 8. A cross-section along line 3A-3A in FIG. 3 of the wash zone 17 and nozzles 18 is shown in FIG. 3A.

Figures 3A, 3B:
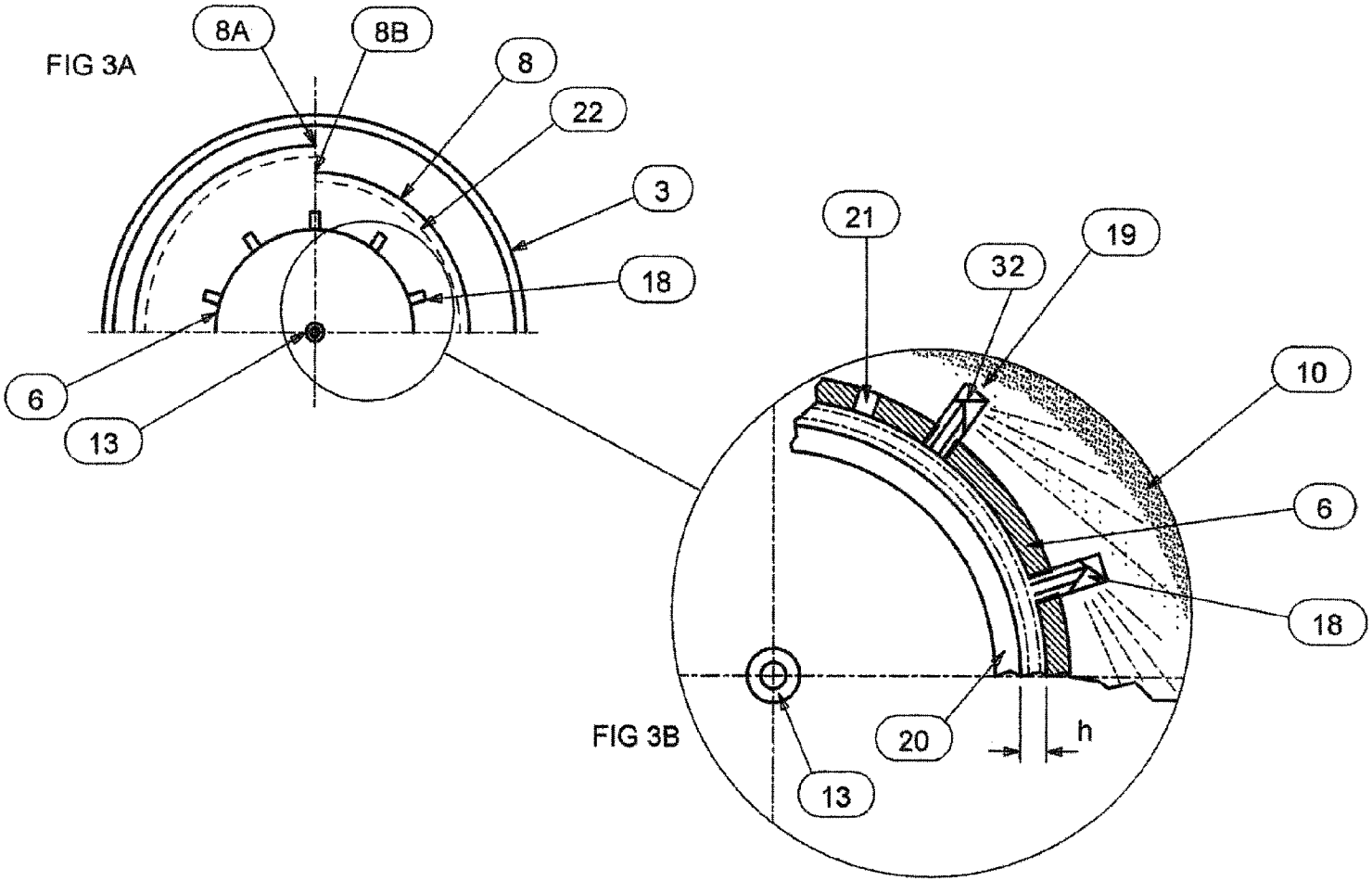
FIG. 3A is a partial cross-sectional view of the wash zone and nozzles on line 3A-3A of FIG. 3.
FIG. 3B is an enlarged sectional view of part of FIG. 3A and showing the mist of fine droplets of wash liquid produced by each nozzle shown in FIG. 3 and FIG. 3A.

Each nozzle 18 produces a mist of fine droplets of wash liquid 19 as shown in FIG. 3B, directed around and in the plane of the helix of the flights 8, which overlap and form a continuous fine spray of mist applied evenly onto the surface of the solids. A deflector surface 32 associated with each nozzle 18 is configured to deflect the wash liquid flowing from the nozzle and produce the mist of fine droplets of wash liquid 19. The deflector surface 32 is positioned at the exit of each nozzle 18. As shown in FIG. 3B, the deflector surface 32 is comprised of a deflector plate positioned at an angle relative to the flow of wash liquid flowing from the exit of each nozzle 18. A chamber 20 in the conveyor hub 6 is supplied with wash liquid by the wash pipe 13 and maintains a pressure head 'h' to supply the energy required by the nozzles to deflect the wash liquid and produce fine droplets. The energy level is sufficient to produce droplets of a diameter less than (or of the same order as) the equivalent solids mean particle diameter to assist flow through the solids. The enlarged view in FIG. 3B shows the nozzles 18, the deflector surfaces 32, the mist of fine droplets 19, and the wash liquid chamber 20. Any excess wash liquid overflows from the chamber 20 and flows through exit ports 21 to the liquid outlet ports 5.

Figure 4:
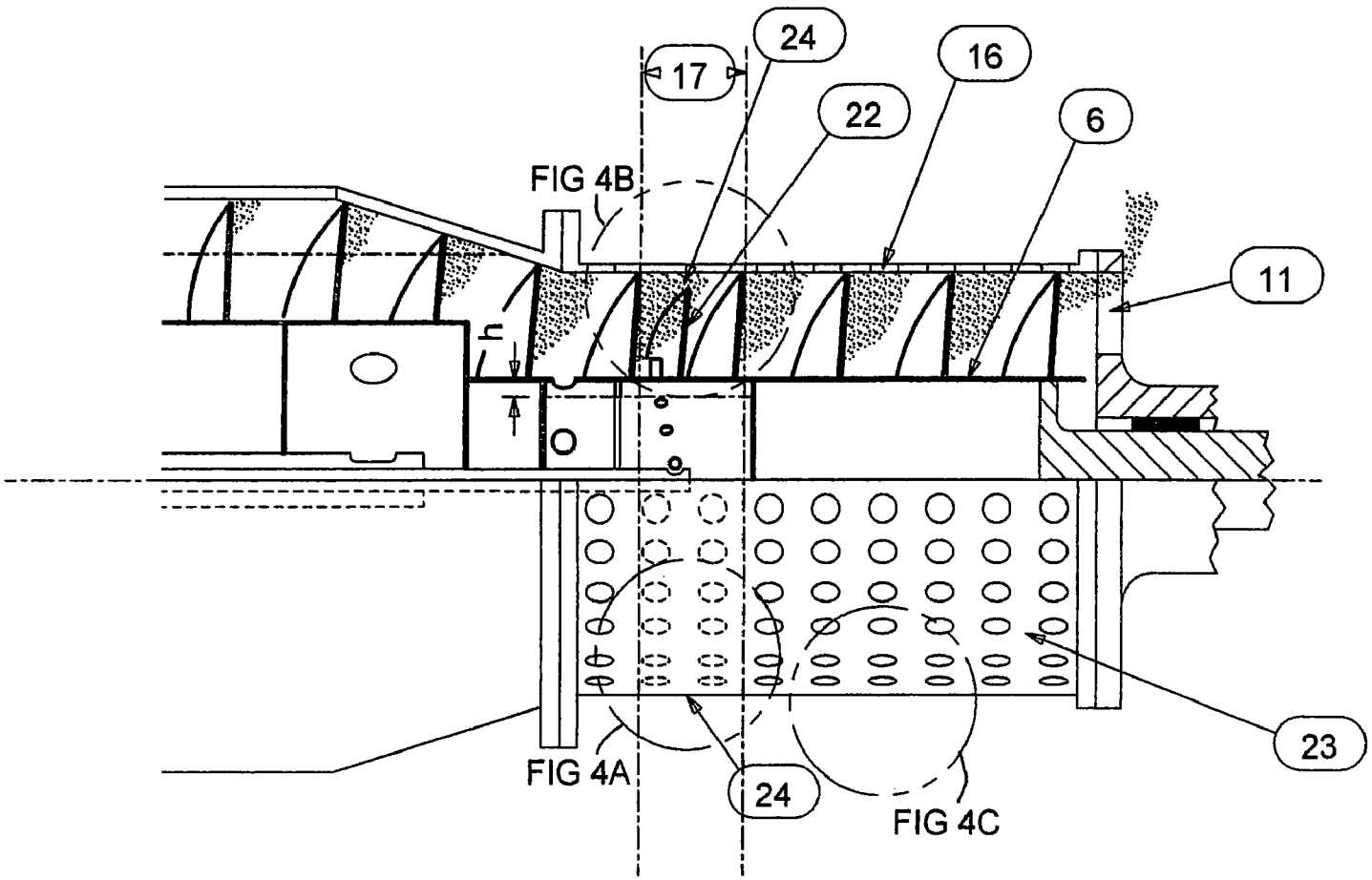
FIG. 4 is a cross-sectional view of a second embodiment of the present invention showing the addition of a screw section to the decanter

In order to direct the droplets evenly over the surface and through the solids volume, an intermediate blade 22, shaped to follow the helix angle of the conveyor flights 8, is fitted to the conveyor in the wash zone. Whilst the clearance between the radially outer edges of the conveyor flights and the inner diameter of the bowl sections 3 is small—typically 1 mm—the clearance 'c' between the blade 22 and the bowl 3 is larger, typically 5 to 50 times that of the conveyor flights. The nozzles 18 are fitted between the intermediate blade 22 and the flights 8A and 8B that define the wash zone 17 so that all the wash liquid droplets, guided by the intermediate blade and flights, flow through to wash all the solids as they pass through the wash zone. As shown in FIGS. 3 and 4, the wash zone 17 is an open helical shaped wash zone free of any obstacles that interrupt the free flow of mist around the full wash zone. As the intermediate blade 22 is positioned substantially parallel to the adjacent flights of the conveyor and helps guide the droplets of wash liquid flow through to wash the solids, the intermediate blade 22 does not constitute an obstacle that interrupts the free flow of mist around the full wash zone. Additionally, as can be seen in FIGS. 3 and 4, the intermediate blade 22 has upper and lower surfaces that face opposite respective surfaces of the adjacent flights 8A and 8B. In the embodiment depicted in FIG. 3, the nozzles 18 are fitted between the opposing substantially parallel surfaces of the blade 22 and the adjacent flight 8A. Thus the limited wash of the surface of the solids that limits wash efficiency with the known decanting centrifuges is replaced by a more evenly distributed washing of the solids—the surfaces of all solid particles in the wash zone contacting the wash liquid as it passes through the wash zone.

The additional frictional forces or drag in the wash zone 17, applied by the intermediate blade 22 to the solids, reduce the velocity of the solids in their passage through the wash zone and thus increases the time that the solids are exposed to the wash liquid. The additional drag also increases the redistribution or churning of the solids (inherent in the scrolling mechanism) and increases the degree of exposure of the solids to the wash liquid—both features adding to the efficiency of washing.

In a preferred arrangement the intermediate blade and the wash zone occupies 360 degrees or one turn of the helix as indicated in FIG. 3A. Wash zones of more or less than 360 degrees may however be used depending on process requirements.

The wash zone 17, nozzles 18 and intermediate blade 22 additions shown in FIG. 3 for the solid bowl are applicable also to the screen bowl decanter.

As shown in FIG. 4, for screen bowl decanter centrifuges, a wash zone 17 can be arranged in the screen bowl section 23 and be bounded by the corresponding section 24 of the screen bowl 23 and conveyor hub 6. Whilst for normal operation the section 23 is fully perforated, section 24 which bounds the wash zone 17, may, depending on process requirements, be perforated or unperforated. In both cases, the wash liquid flows through the solids bulk as described above for the solid bowl decanter.

Figure 4B:
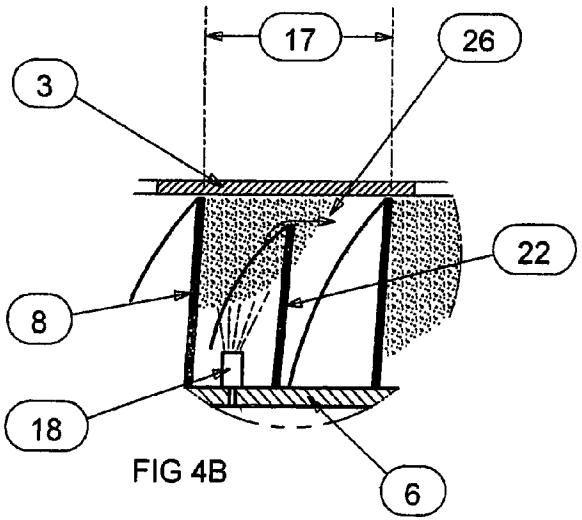
FIG. 4B shows another part of the wash zone of FIG. 4B.
Figure 4C:
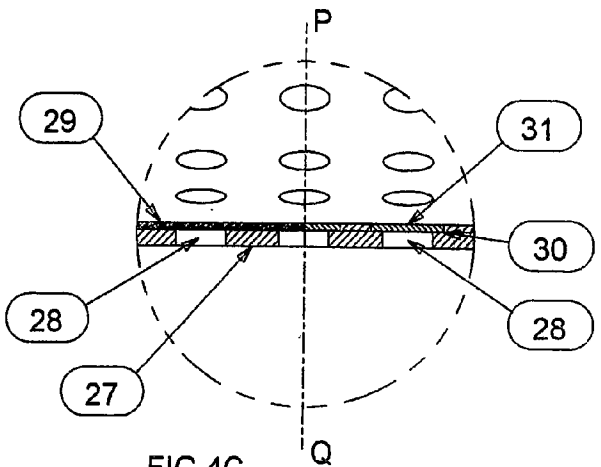
FIG. 4C is a section of two typical constructions of screen sections.
Figure 4A:
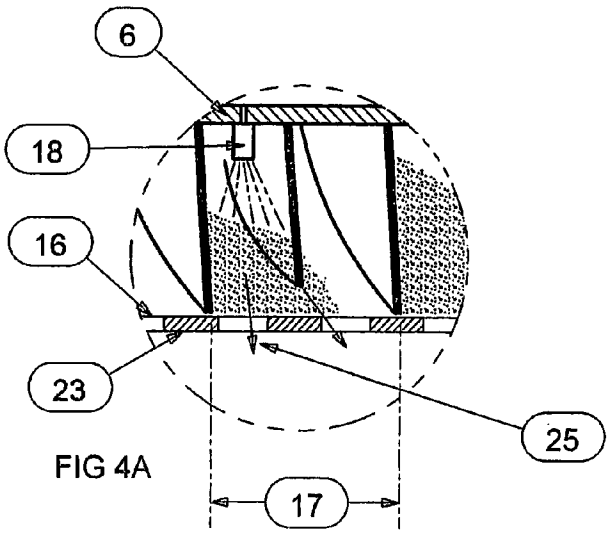
FIG. 4A shows part of the wash zone of the embodiment of FIG. 4.

If the process requires the removal of the fine solids (fine solids being defined as solids smaller than the perforations/slots 16 of the screen bowl decanter centrifuge) before the solids are discharged from the solid outlet 11, then the section bounding the wash zone is perforated, as shown in the lower part of FIG. 4 and in more detail in FIG. 4A. The wash liquid passes through the bulk of the solids, as described above, flows outwards through the screen perforations/slots 16 in the direction of arrow 25, carrying fine solids through the screen to be discharged with the wash liquid.

If the process requires the separation and discharge of the maximum amount of solids, the section bounding the wash zone should not be perforated (as shown in the upper part of FIG. 4 and in more detail in FIG. 4B). The wash liquid, having passed through the solids, flows in the direction of the arrow 26, leaving fine solids (that would otherwise be washed through the perforations/slots by the wash liquid) embedded in the bulk of the solids. The solids, including the fine solids, are then scrolled and discharged with the larger solid particles from the solids outlet 11. The wash liquid also washes any small volume of solids being scrolled by the leading face of the intermediate blade 22.

In a preferred embodiment, the intermediate blade and wash zone occupy 360° or one turn of the helix. Wash zones of more or less than 360° may be used depending on process requirements. A plurality of wash zones along the length of the screen section 23 is an option for a screen bowl design, using the axial length of the screen section to the best advantage to optimize (a) washing efficiency, (b) the dryness of the derived solids and (c) the removal or retardation of fine solids.

Figure 1:
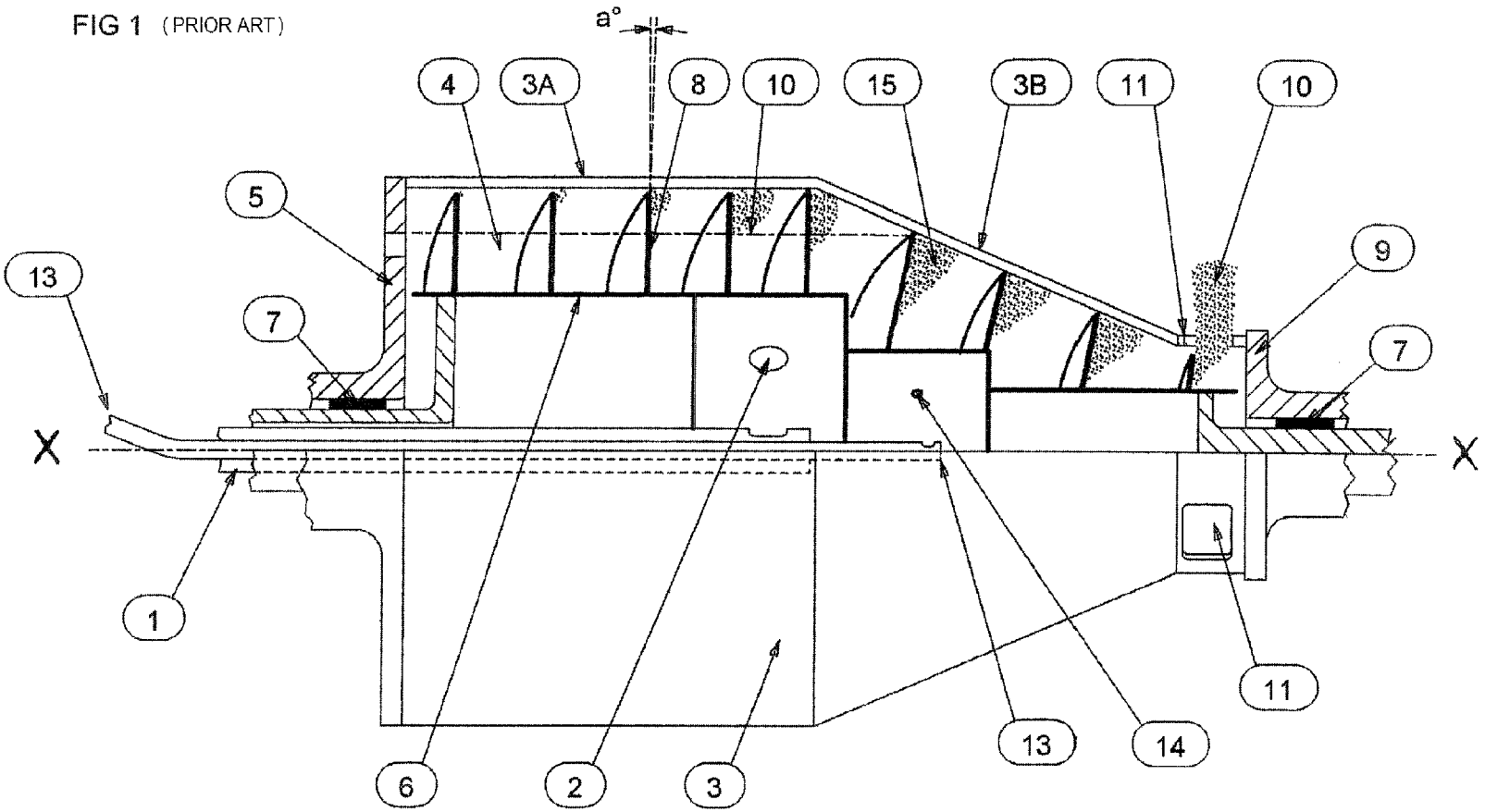
FIG 1 (PRIOR ART)
FIG. 1 is a cross-sectional view of a conventional solid bowl decanter centrifuge.
Figure 2:
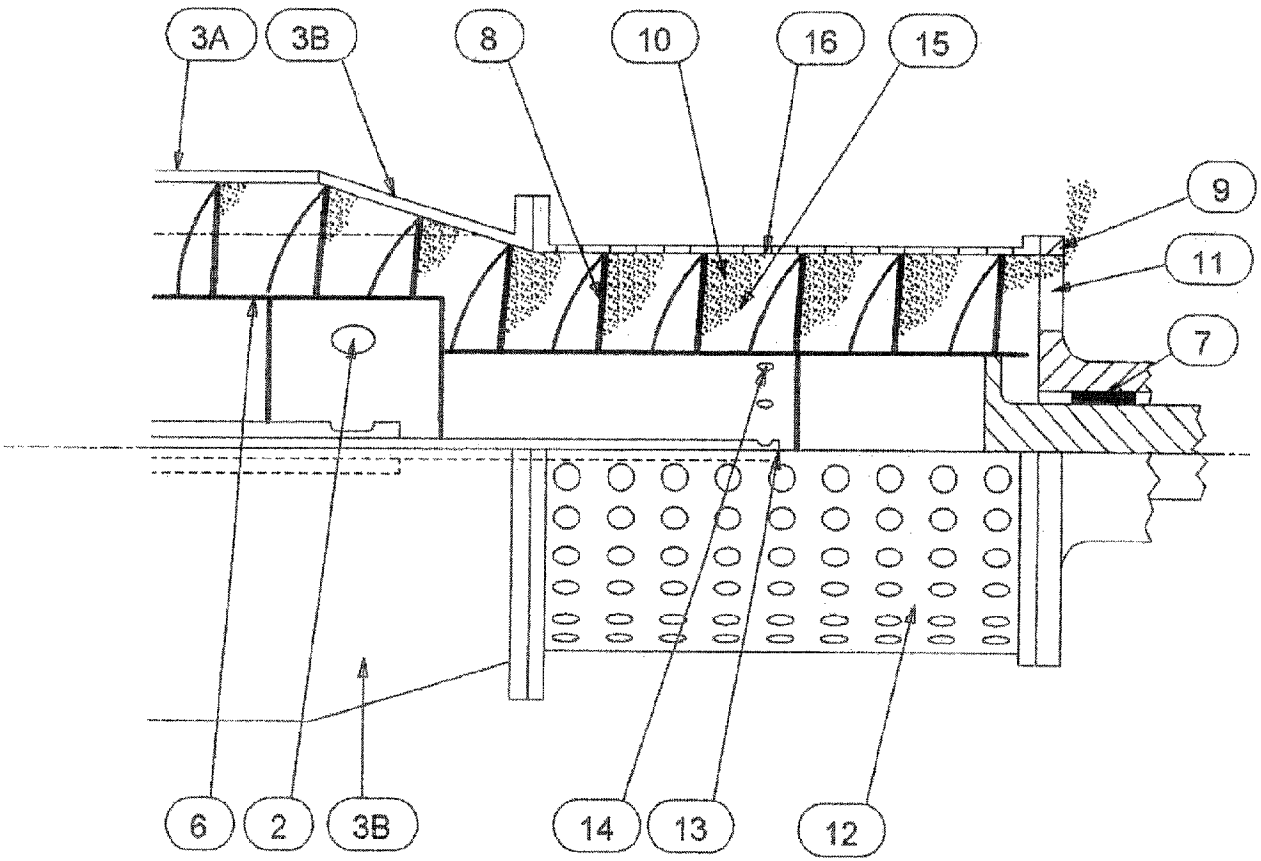
FIG 2 (PRIOR ART)
FIG. 2 is a cross-sectional view showing adaptations to convert the conventional solid bowl decanter of FIG. 1 to a conventional screen bowl decanter centrifuge.

For the purposes of clarity only, the screen sections 12 and 23 are shown in FIGS. 2 and 4 as single perforated drums. In practice such a section is constructed with a substantial outer drum 27, designed to withstand the rotational stresses, and in which relatively large holes (typically 20 to 50 mm diameter) are cut. The drum supports a thinner screen, which is finely perforated or slotted, on which the solids are scrolled and separation occurs. FIG. 4C shows a section of two typical constructions. The first, on the left of line PQ, shows the outer drum 27 in which the holes 28 are cut. The drum supports a continuous separating screen 29 finely perforated (typically 0.2 to 1.5 mm diameter minimum slot width) to retain the solids. The second construction is shown on the right of line PQ. The holes 28 are recessed 30 on the inner surface of the drum into which small individual fine screen sections 31 are fitted. With screens of the second construction, the unperforated zone 24 may be created by blocking the holes cut in the outer drum 27 in the wash zone, leaving the remaining perforated screens 12 in place. For the first construction, the wash zone may be bounded by an unperforated plate or the screen 12 may be made unperforated at the wash zone(s).

The invention claimed is:

1. A solid or screen bowl decanting-type centrifuge comprising:

a rotatable bowl for separating a slurry fed thereto into its constituent solids and liquid;

a helical scroll conveyor which rotates coaxially within the bowl at a different rotational speed, the helical scroll conveyor comprising a conveyor hub carrying a plurality of flights whose radially outer edges lie close to an inner wall of the bowl such that, in use, separated solids are scrolled by the conveyer to solids discharge ports at one end of the bowl, with separated liquid being discharged from liquids discharge ports at the opposite end of the bowl;

a plurality of nozzles carried by the conveyor hub in a wash zone for supplying wash fluid to solids being scrolled by the conveyer towards the solids discharge ports, the nozzles being arranged to produce respective mists of fine droplets of wash liquid which overlap to form a continuous fine spray of mist applied, in use, to the surface of said solids, wherein the wash zone is an open helical shaped wash zone free of any obstacles that interrupt the free flow of mist around the full wash zone; and at least one blade carried by the conveyor hub in the region of the nozzles and intermediate adjacent flights of the conveyor for directing fluid droplets from the nozzles over and through said solids, wherein the blade is shaped to follow a helix angle of the flights of the conveyor, the blade having a surface facing opposite and substantially parallel to a surface of an adjacent flight of the conveyor, with the plurality of nozzles fitted between the opposing substantially parallel surfaces of the blade and the adjacent flight of the conveyor.

2. A centrifuge according to claim 1, wherein the blade has a radially outer edge which is spaced from an inner wall of the bowl by a greater amount than said radially outer edges of the conveyer flights.

3. A centrifuge according to claim 2, wherein the radial clearance between said blade and the inner surface of the bowl is between 5 to 50 times larger than that of the conveyor flights.

4. A centrifuge according to claim 1, wherein said blade and said wash zone occupy substantially 360° around the conveyor hub.

5. A centrifuge according to claim 1, wherein said plurality of nozzles are disposed between adjacent conveyor flights in a line which follows a helix angle of the conveyor.

6. A centrifuge according to claim 1, further comprising a chamber in the conveyor hub which is arranged to receive wash liquid supplied by a wash liquid source and to maintain a pressure head sufficient to supply the energy required by the nozzles to deflect the wash liquid and produce the liquid droplets.

7. A centrifuge according to claim 6 wherein the chamber is configured to maintain a pressure head that supplies energy to the wash liquid to produce droplets of a size similar to that of the solid particles.

8. A centrifuge according to claim 1 wherein, in the case that the centrifuge is of a solid bowl type, the wash zone is located in a frusto-conical section of the bowl.

9. A centrifuge according to claim 1 wherein, in the case that the centrifuge is of a screen bowl type, the wash zone is located in a perforated screen section of the bowl or in the frusto conical section.

10. A centrifuge according to claim 1 wherein, in the case that the centrifuge is of a screen bowl type, the wash zone is located in the perforated section of the bowl, with the perforations blocked or removed in the wash zone.

11. A centrifuge according to claim 1, having multiple wash zones along the bowl or screen section.

12. A centrifuge according to claim 1, further comprising a deflector surface associated with each nozzle, wherein the deflector surface is configured to deflect wash liquid flowing from the nozzle and produce the respective mists of fine droplets of wash liquid.

13. A centrifuge according to claim 12, wherein the deflector surface is respectively positioned at the exit of each nozzle.

14. A centrifuge according to claim 13, wherein the deflector surface is comprised of a deflector plate positioned at an angle relative to the flow of wash liquid flowing from the exit of each nozzle.

15. A centrifuge according to claim 14, further comprising a liquid chamber in fluid communication with the nozzles, wherein the liquid chamber is configured to maintain a pressure head sufficient to supply energy to the wash liquid flowing from the nozzles to produce droplets of a diameter on the same order or less than the mean particle diameter of the solids being scrolled by the conveyer towards the solids discharge ports.

16. A solid or screen bowl decanting-type centrifuge comprising:

a rotatable bowl for separating a slurry fed thereto into its constituent solids and liquid;

a helical scroll conveyor which rotates coaxially within the bowl at a different rotational speed, the helical scroll conveyor comprising a conveyor hub carrying a plurality of flights whose radially outer edges lie close to an inner wall of the bowl such that, in use, separated solids are scrolled by the conveyer to solids discharge ports at one end of the bowl, with separated liquid being discharged from liquids discharge ports at the opposite end of the bowl;

a plurality of nozzles carried by the conveyor hub in a wash zone for supplying wash fluid to solids being scrolled by the conveyer towards the solids discharge ports, the nozzles being arranged to produce respective mists of fine droplets of wash liquid which overlap to form a continuous fine spray of mist applied, in use, to the surface of said solids; and at least one blade carried by the conveyor hub in the region of the nozzles and intermediate adjacent flights of the conveyor for directing fluid droplets from the nozzles over and through said solids, wherein the blade and the wash zone occupy substantially 360° around the conveyor hub.

17. A centrifuge according to claim 16, wherein the blade is shaped to follow a helix angle of the flights of the conveyor, the blade having a surface facing opposite and substantially parallel to a surface of an adjacent flight of the conveyor, with the plurality of nozzles fitted between the opposing substantially parallel surfaces of the blade and the adjacent flight of the conveyor.

18. A centrifuge according to claim 16, further comprising a deflector surface associated with each nozzle, wherein the deflector surface is configured to deflect wash liquid flowing from the nozzle and produce the respective mists of fine droplets of wash liquid.

19. A centrifuge according to claim 18, wherein the deflector surface is respectively positioned at the exit of each nozzle.

20. A centrifuge according to claim 19, wherein the deflector surface is comprised of a deflector plate positioned at an angle relative to the flow of wash liquid flowing from the exit of each nozzle.

* * * * *